US006170490B1

(12) United States Patent
Barrow

(10) Patent No.: US 6,170,490 B1
(45) Date of Patent: Jan. 9, 2001

(54) SMOKING ACCESSORY

(76) Inventor: Karen L. Barrow, 43 Deschene Dr., Thomasville, GA (US) 31757

( * ) Notice: Under 35 U.S.C. 154(b), the term of this patent shall be extended for 0 days.

(21) Appl. No.: 09/333,068

(22) Filed: Jun. 14, 1999

(51) Int. Cl.[7] ..... A24F 13/18; A24F 19/14; A24F 15/00

(52) U.S. Cl. ..... 131/236; 131/235.1; 131/256; 206/246

(58) Field of Search ..... 131/235.1, 256, 131/236, 329, 237.5; 206/246; 220/230

(56) References Cited

U.S. PATENT DOCUMENTS

| | | | |
|---|---|---|---|
| 4,146,043 | 3/1979 | Itoh | 131/236 |
| 4,346,719 | 8/1982 | Hilkene | 131/236 |
| 4,548,217 | 10/1985 | Saculla | 131/235.1 |
| 4,953,571 | 9/1990 | Tumblay | 131/231 |
| 5,038,801 | 8/1991 | Wang | 131/236 |
| 5,601,096 | 2/1997 | Lin | 131/240.1 |

FOREIGN PATENT DOCUMENTS

| | | | |
|---|---|---|---|
| 150383 * | 1/1932 | (CH) | 131/236 |

* cited by examiner

*Primary Examiner*—James Derrington
*Assistant Examiner*—Dionne A. Walls
(74) *Attorney, Agent, or Firm*—Joseph N. Breaux

(57) ABSTRACT

A smoking accessory that includes a chamber for containing a scented cigarette dousing liquid that is used to simultaneously douse the cigarette and provide a quantity of scenting agent on the cigarette butt to mask the smell of the cigarette butt when it is stored within a sealable cigarette butt storage chamber also formed within the smoking accessory.

1 Claim, 2 Drawing Sheets

SMOKING ACCESSORY

TECHNICAL FIELD

The present invention relates to ashtrays and the like and more particularly to a smoking accessory that includes an externally threaded lower housing including the scented dousing liquid chamber and the butt disposal storage chamber formed separately within the lower housing; the internally, companionately threaded screw on metal, sealing cap with the dousing liquid chamber opening, the butt disposal storage opening, the sealing disk pivot fastener and a portion of the resilient sealing gasket positioned within the interior portion of the screw on sealing cap; and the resilient magnetic rubber sealing disk having a disk pivot fastener aperture, a sealing disk liquid chamber opening, and a sealing disk butt disposal storage opening; the internal companionately threading of the sealing cap be oriented such that when the sealing cap is fully threaded onto the external threads of the lower housing, the dousing liquid chamber opening is positioned over the scented dousing liquid chamber, the butt disposal storage opening is positioned over the butt disposal chamber, and the resilient sealing gasket forming a liquid tight seal separating the the scented dousing liquid chamber and the butt disposal storage chamber.

BACKGROUND ART

Cigarette smokers are typically becoming more concerned with the disposal of the cigarette butts and ashes generated from smoking. In addition, the scent of cigarette butts in a closed environment such as a car can make traveling in the car distasteful for many individuals who are non-smokers. It would be a benefit, therefore, to have a smoking accessory that included a chamber for containing a scented cigarette dousing liquid that could be used to simultaneously douse the cigarette and provide a quantity of scenting agent on the cigarette butt to mask the smell of the cigarette butt when it is stored within a sealable cigarette butt storage chamber preferably formed within the smoking accessory.

GENERAL SUMMARY DISCUSSION OF INVENTION

It is thus an object of the invention to provide a smoking accessory that includes a chamber for containing a scented cigarette dousing liquid that is used to simultaneously douse the cigarette and provide a quantity of scenting agent on the cigarette butt to mask the smell of the cigarette butt when it is stored within a sealable cigarette butt storage chamber formed within the smoking accessory.

It is a further object of the invention to provide a smoking accessory that includes an externally threaded lower housing including the scented dousing liquid chamber and the butt disposal storage chamber formed separately within the lower housing; the internally, companionately threaded screw on metal, sealing cap with the dousing liquid chamber opening, the butt disposal storage opening, the sealing disk pivot fastener and a portion of the resilient sealing gasket positioned within the interior portion of the screws on sealing cap; and the resilient magnetic rubber sealing disk having a disk pivot fastener aperture, a sealing disk liquid chamber opening, and a sealing disk butt disposal storage opening; the internal companionately threading of the sealing cap be oriented such that when the sealing cap is fully threaded onto the external threads of the lower housing, the dousing liquid chamber opening is positioned over the scented dousing liquid chamber, the butt disposal storage opening is positioned over the butt disposal chamber, and the resilient sealing gasket forming a liquid tight seal separating the the scented dousing liquid chamber and the butt disposal storage chamber.

Accordingly, a smoking accessory is provided. The smoking accessory includes an externally threaded lower housing including the scented dousing liquid chamber and the butt disposal storage chamber formed separately within the lower housing; the internally, companionately threaded screw on metal, sealing cap with the dousing liquid chamber opening, the butt disposal storage opening, the sealing disk pivot fastener and a portion of the resilient sealing gasket positioned within the interior portion of the screw on sealing cap; and the resilient magnetic rubber sealing disk having a disk pivot fastener aperture, a sealing disk liquid chamber opening, and a sealing disk butt disposal storage opening; the internal companionately threading of the sealing cap be oriented such that when the sealing cap is fully threaded onto the external threads of the lower housing, the dousing liquid chamber opening is positioned over the scented dousing liquid chamber, the butt disposal storage opening is positioned over the butt disposal chamber, and the resilient sealing gasket forming a liquid tight seal separating the the scented dousing liquid chamber and the butt disposal storage chamber.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
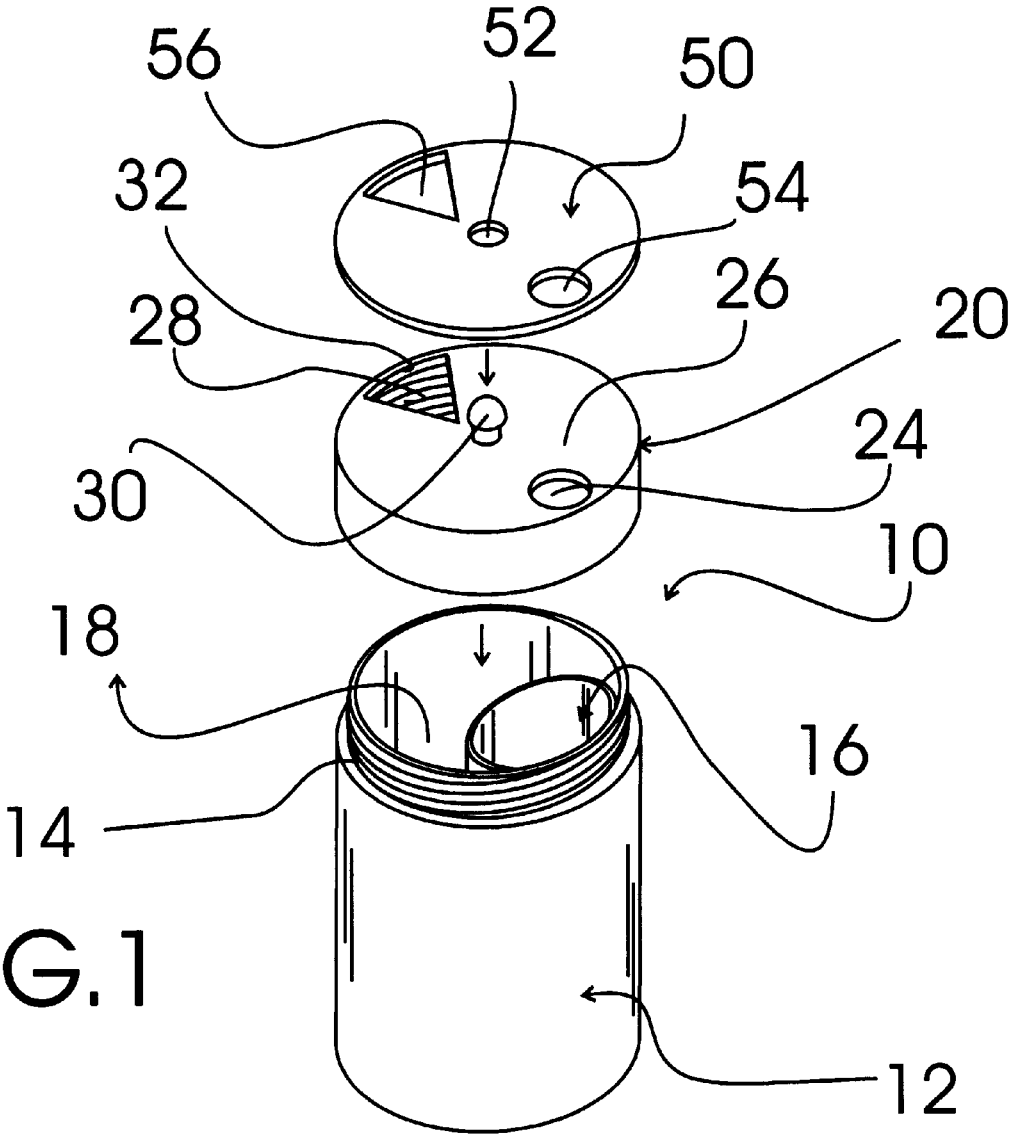
FIG. 1 is an exploded perspective view of an exemplary embodiment of the smoking accessory of the present invention showing the externally threaded lower housing including the scented dousing liquid chamber and the butt disposal storage chamber formed separately within the lower housing; the internally, companionately threaded screw on metal, sealing cap with the dousing liquid chamber opening, the butt disposal storage opening, the sealing disk pivot fastener and a portion of the resilient sealing gasket positioned within the interior portion of the screw on sealing cap; and the resilient magnetic rubber sealing disk having a disk pivot fastener aperture, a sealing disk liquid chamber opening, and a sealing disk butt disposal storage opening; the internal companionately threading of the sealing cap be oriented such that when the sealing cap is fully threaded onto the external threads of the lower housing, the dousing liquid chamber opening is positioned over the scented dousing liquid chamber, the butt disposal storage opening is positioned over the butt disposal chamber, and the resilient sealing gasket forming a liquid tight seal separating the the scented dousing liquid chamber and the butt disposal storage chamber.
Figure 2:
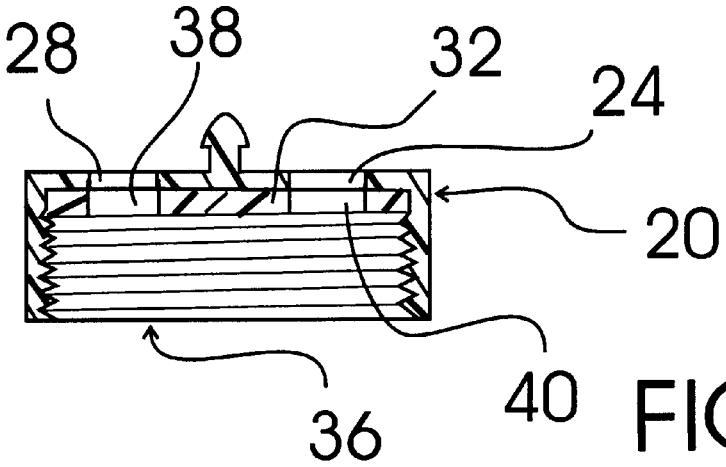
FIG. 2 is a sectional view through the screw on sealing cap of FIG. 1 showing the internal threading, the dousing liquid chamber opening, the butt disposal storage opening, the sealing disk pivot fastener, and the resilient sealing gasket positioned within the interior portion of the screw on sealing cap and including a gasket butt insertion opening and a gasket dousing liquid chamber opening.

FIG. 1 shows an exemplary embodiment of the smoking accessory of the present invention generally designated 10. Smoking accessory 10 includes an lower housing, generally designated 12 having an externally threaded upper lip 14 and including a scented dousing liquid chamber, generally designated 16 and butt disposal storage chamber, generally designated 18, formed separately within lower housing 12; a metal sealing cap, generally designated 20 that is internally companionately threaded with external threads 14 of lower housing 12, a circular dousing liquid chamber opening 24 formed through a top surface 26 thereof, a pie slice shaped butt disposal storage opening 28 formed through top surface 26, a sealing disk pivot fastener 30 extending from the center of top surface 26 and a resilient sealing gasket 32 (with reference now to FIG. 2) positioned within the interior portion 36 of screw on sealing cap. Resilient sealing gasket 32 also includes a gasket butt insertion opening 38 and a gasket dousing liquid chamber opening 40 that are aligned with, referring back to FIG. 1, scented dousing liquid chamber 16 and butt disposal storage chamber 18 when sealing cap 20 is fully screwed onto lower housing 12.

Smoking accessory 10 also includes a resilient magnetic rubber sealing disk, generally designated 50 having a disk pivot fastener apertures 52 that is snap fittable over the enlarged tip end of sealing disk pivot fastener 30, a sealing disk liquid chamber opening 54, and a sealing disk butt disposal storage opening 56.

Figure 3:
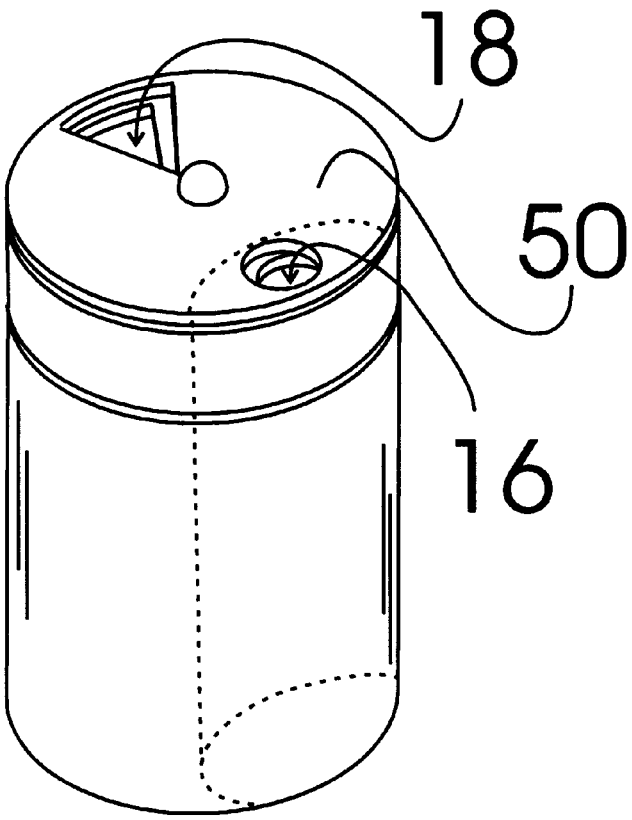
FIG. 3 is a perspective view showing the exemplary smoking accessory of FIG. 1 with the resilient magnetic rubber sealing disk rotates to allow access into the dousing liquid chamber, and the butt disposal storage chamber.
Figure 4:
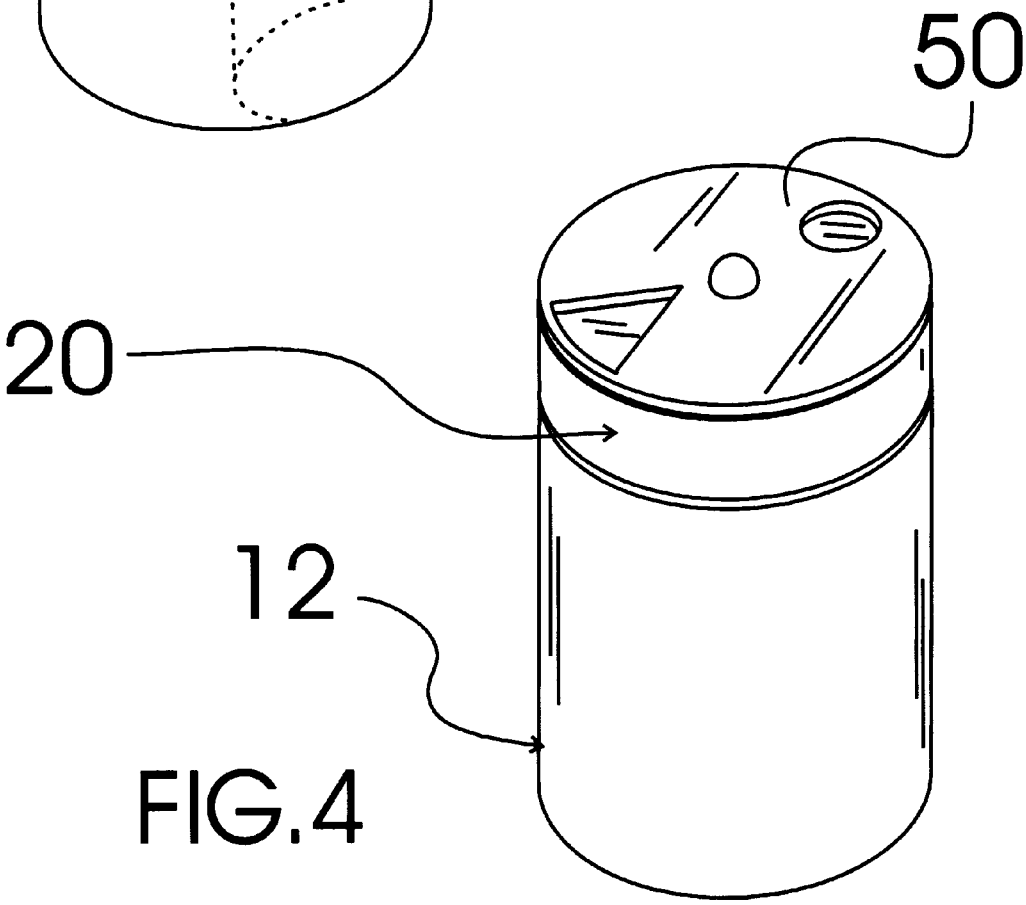
FIG. 4 is a perspective view showing the exemplary smoking accessory of FIG. 1 with the resilient magnetic rubber sealing disk rotated to block the dousing liquid chamber opening, and the butt disposal storage opening.

With reference to FIG. 3, in use, resilient magnetic sealing disk 50 s rotatable with respect to metal sealing cap 20 to allow the user to access scented dousing liquid chamber 16 and butt disposal storage chamber 18. Referring to FIG. 4, when smoking is over, liquid chamber opening 54 (FIG. 1) and sealing disk butt disposal storage opening 56 (FIG. 1) are sealed by rotating resilient magnet sealing disk 50 is rotated out of alignment with liquid chamber opening 54 (FIG. 1) and sealing disk butt disposal storage opening 56 (FIG. 1) and the magnetic attraction between resilient magnetic sealing disk and top surface 26 forms a seal to prevent liquid within scented dousing liquid chamber 16 (FIG. 1) from leaking. If desired a clip can be provided on sealing disk 50 to hold a cigarette or cigar.

It can be seen from the preceding description that a smoking accessory has been provided that includes an externally threaded lower housing including the scented dousing liquid chamber and the butt disposal storage chamber formed separately within the lower housing; the internally, companionately threaded screw on metal, sealing cap with the dousing liquid chamber opening, the butt disposal storage opening, the sealing disk pivot fastener and a portion of the resilient sealing gasket positioned within the interior portion of the screw on sealing cap; and the resilient magnetic rubber sealing disk having a disk pivot fastener aperture, a sealing disk liquid chamber opening, and a sealing disk butt disposal storage opening; the internal companionately threading of the sealing cap be oriented such that when the sealing cap is fully threaded onto the external threads of the lower housing, the dousing liquid chamber opening is positioned over the scented dousing liquid chamber, the butt disposal storage opening is positioned over the butt disposal chamber, and the resilient sealing gasket forming a liquid tight seal separating the the scented dousing liquid chamber and the butt disposal storage chamber.

It is noted that the embodiment of the smoking accessory described herein in detail for exemplary purposes is of course subject to many different variations in structure, design, application and methodology. Because many varying and different embodiments may be made within the scope of the inventive concept (s) herein taught, and because many modifications may be made in the embodiment herein detailed in accordance with the descriptive requirements of the law, it is to be understood that the details herein are to be interpreted as illustrative and not in a limiting sense.

What is claimed is:

1. A smoking accessory comprising:

an externally threaded lower housing including a scented dousing liquid chamber and a butt disposal storage chamber formed separately within the lower housing;

an internally threaded screw-on metal, sealing cap with a dousing liquid chamber opening, a butt disposal storage opening, a sealing disk pivot fastener and a portion of a resilient sealing gasket positioned within the interior portion of the screw-on sealing cap; and a resilient magnetic rubber sealing disk having a disk pivot fastener aperture, a sealing disk liquid chamber opening, and a sealing disk butt disposal storage opening;

wherein the internal threading of the sealing cap is oriented such that when said sealing cap is fully threaded in a companionate manner onto the external threads of the lower housing, the dousing liquid chamber opening is positioned over the scented dousing liquid chamber, the butt disposal storage opening is positioned over the butt disposal chamber and the resilient sealing gasket forms a liquid tight seal separating the scented dousing liquid chamber and the butt disposal storage chamber;

and wherein the resilient magnetic rubber sealing disk is snap fittable over an enlarged tip end of the sealing disk pivot fastener, the sealing disk liquid chamber opening, and the sealing disk butt disposal storage opening.

* * * * *